US005800219A

United States Patent [19]

Siedlik et al.

[11] Patent Number: 5,800,219

[45] Date of Patent: Sep. 1, 1998

[54] STAMPED BATTERY TERMINAL

[75] Inventors: Henry A. Siedlik, Novi; Zenon Hotra, Troy, both of Mich.

[73] Assignee: United Technologies Automotive, Inc., Dearborn, Mich.

[21] Appl. No.: 767,900

[22] Filed: Dec. 17, 1996

[51] Int. Cl.[6] ..... H01R 4/42

[52] U.S. Cl. ..... 439/762; 439/764

[58] Field of Search ..... 439/761–764

[56] References Cited

U.S. PATENT DOCUMENTS

| | | | |
|---|---|---|---|
| 1,334,833 | 3/1920 | Bijur . | |
| 5,183,419 | 2/1993 | Dewar | 439/762 |
| 5,221,219 | 6/1993 | Thomson | 439/762 |
| 5,302,143 | 4/1994 | Inoue | 439/762 |
| 5,454,741 | 10/1995 | Okada | 439/762 |
| 5,486,434 | 1/1996 | Aoyama | 439/765 |
| 5,595,510 | 1/1997 | Obligar | 439/764 |
| 5,645,448 | 7/1997 | Hill | 439/763 |

FOREIGN PATENT DOCUMENTS

| | | |
|---|---|---|
| 0632530 | 5/1994 | European Pat. Off. . |
| 3830826 | 3/1989 | Germany . |

*Primary Examiner*—Gary F. Paumen
*Attorney, Agent, or Firm*—Howard & Howard

[57] ABSTRACT

In automotive applications, a storage battery is substantially box-like and includes a first surface and a second surface. An electrical terminal is disposed on the first surface. An apparatus is used no connect a battery cable to the battery. The apparatus includes a first conductor and a second conductor. The first conductor is adapted for attaching to the electrical terminal. The second conductor is adapted for attaching the battery cable to the first conductor. The conductors are shaped to conform with a change in contour between the first surface and the second surface of the battery.

7 Claims, 1 Drawing Sheet

STAMPED BATTERY TERMINAL

TECHNICAL FIELD

The present application relates to terminal connectors for storage batteries, and more particularly to a stamped battery terminal for automobile storage batteries and the like.

BACKGROUND OF THE INVENTION

Storage batteries for automotive applications are generally box-shaped structures with two metal posts extending from the upper surface. In order for the power generated by the battery to reach other vehicle components, battery cables must be electrically connected to the posts. Conventionally stamped battery terminals are used for this connection.

Stamped battery terminals include a body member formed from a single piece of sheet metal and a fastener assembly. The body member is formed into a clamp section for attachment to the battery post and a wire connection section for a crimp connection to the battery cable.

In use the clamp section is slid over and encircles the battery post in the open position. When the fastener assembly is tightened it compresses the clamp section about the post. In the clamped or closed position, the terminal achieves good mechanical and electrical connection to the battery post.

The battery cable includes a conductive core sheathed in an insulator. The cable is connected to the wire connection section of the terminal by crimping the wire connection section into a closed position about the conductive core. Thus, the cable is electrically connected to the battery post through the terminal.

Due to the configuration of the terminal, the battery cable extends from the wire connection section parallel to the upper surface of the battery. In order to route the cable from the battery through the engine compartment of the vehicle the cable must be bent downward into a curve. Since the cable is thick and relatively stiff, bending it is difficult. Furthermore, bending the cable increases the amount of cable needed versus a straight cable. This is undesirable, since the cable is expensive.

Some terminals include a separate element for gripping the cable. The element is substantially L-shaped and has a hole adjacent one free end and a wire connection portion at the other free end. In use the post is disposed through the hole, so that the element is in electrical contact with the post and a clamp section. Once connected to the element, the battery cable exits the element substantially parallel to the side wall of the battery. Thus, bending of the cable during installation is minimized. However, since engine layouts vary from vehicle to vehicle this element cannot be used in cars where the engine configuration interferes with the geometry of the element.

What is therefore needed in the art is an improved stamped battery terminal which allows routing of the battery cable from the battery in a variety of engine layouts and decreases the amount of cable necessary.

SUMMARY OF THE INVENTION

According to an embodiment of the present invention, an apparatus for connecting a battery cable to a substantially box-like battery is disclosed. The battery includes a first and a second surface. An electrical terminal is disposed on the first surface. An apparatus is used to connect a battery cable to the battery. The apparatus includes a first conductor and a second conductor. The first conductor is adapted for attaching to the electrical terminal. The second conductor is adapted for attaching the battery cable to the first conductor. The conductors are shaped to conform with a change in contour between the first surface and the second surface of the battery.

In one embodiment, the first conductor and the second conductor are moveable relative to the terminal before attaching the apparatus to the terminal.

The foregoing invention will become more apparent in the following detailed description of the best mode for carrying out the invention and in the accompanying drawings.

Figures 1, 2, 2A, 3:
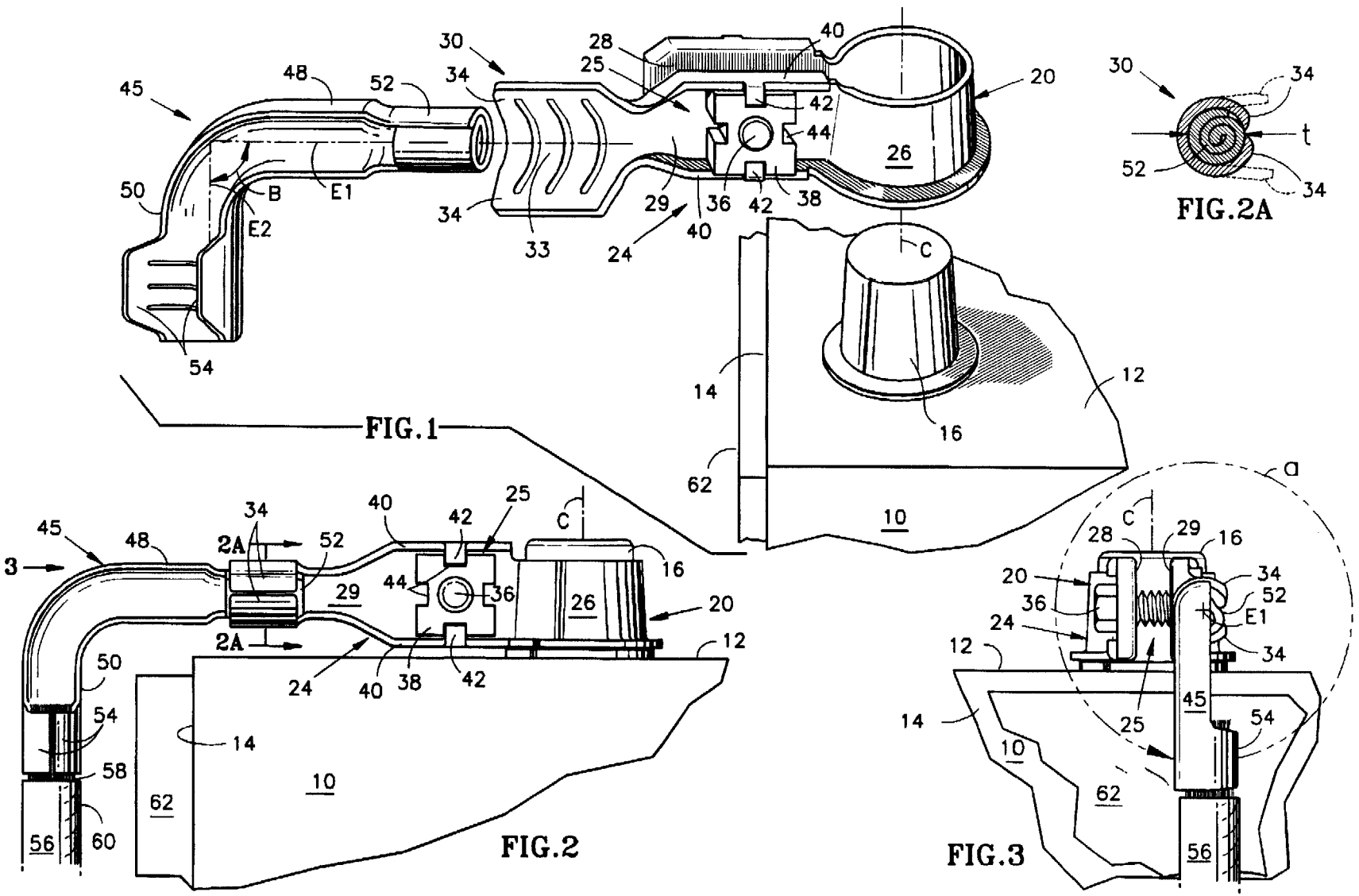
FIG. 1 is a perspective view of one embodiment of a stamped battery terminal of the present invention.
FIG. 2*a* is a cross-sectional view along line 2*a*—2*a* in FIG. 2 of the terminal.
FIG. 2 is a front view of the terminal of FIG. 1 connected to a battery.
FIG. 3 is a left side view along line 3 of FIG. 2 of the terminal.

These figures are meant to be exemplary and not to limit the generally broad scope of the present invention.

BEST MODE FOR CARRYING OUT AN EMBODIMENT OF THE INVENTION

Referring to FIG. 1, a battery 10 for use in automotive applications is a box-shaped wall structure including a first surface 12 and a second surface 14. The battery 10 further includes two posts 16 (one of which being shown), which extend from the first surface 12. Each post 16 has a central axis C extending therethrough.

A stamped battery terminal 20 is operatively associated with the battery 10. The terminal 20 is formed from a single piece of sheet metal, and includes a body member 24 and a fastener assembly 25.

The body member 24 includes a clamp section 26 for attachment to the battery post 16, two end walls 28 and 29 for supporting the fastener assembly 25, and a connection section 30.

The clamp section 26 is substantially C-shaped. The two end walls 28 and 29 extend from the free ends of the clamp section 26. With the terminal 20 in an open position, the end walls 28 and 29 are spaced from one another. Typically, these end walls are straight, and have a hole (not shown) centrally formed therein.

The connection section 30 includes a base 33 and a first set of tabs 34. The base 33 is integrally formed from the end wall 29. The tabs 34 are integrally formed from the base 33 to extend there from. The tabs 34 are initially set in an open configuration, so that they are spaced, from one another.

The fastener assembly 24 comprises a threaded bolt 36 and nut 38. The bolt 36 extends through holes in the end walls 28 and 29, and the nut 38 is threadably engaged with the free end of the bolt 36 on the exterior of the associated end wall 29. The nut may be of the type which is conventionally used for anti-rotation such as those manufactured by Cam Car under part number N804400-520.

As shown in FIG. 2, the terminal may be modified so that the end wall 29 has spaced, longitudinally extending ridges 40. Each ridge 40 having a tab 42. The nut 38 used with this terminal is square shaped and has notches 44 disposed in each face of the nut, such that the tabs 42 mate with the notches 44 upon use.

An apparatus 45 is an extension attachable to the terminal 20 for attaching the cable 56 to the battery 10. The apparatus 45 includes a first conductor 48 integrally formed with a second conductor 50. The first and second conductors have longitudinally extend axes E1 and E2, respectively. The apparatus 45 has a shape to conform with a change in contour between the first and second surfaces 12 and 14. In this embodiment, the apparatus is bent so that the second conductor 50 at a predetermined angle to the first conductor 48. The predetermined angle between E1 and E2, and represented by the angle B. Thus, the apparatus is substantially L-shaped.

The preferred range for the angle B is greater than or equal to approximately 90° and less than or equal to 135±5°. The recommended range for the angle B is greater than or equal to approximately 90° and less than 180°±5°. The angle B depends on the path along which the cable must be routed within the engine compartment.

The free end of the first conductor 48 includes a connection portion 52 for attaching the apparatus to the terminal. Referring to FIG. 2*a*, the thickness t of the connection portion 52 must be massive enough so that once the tabs 34 are crimped about it the crimp is firm. Once crimped to the terminal the first conductor 48 extends therefrom substantially perpendicular to the central axis C of the post 16.

The necessary thickness can be achieved in a number of ways. For example, the portion 52 can be formed by rolling material into a cylindrical shape; crimping in two sides of portion and longitudinally bending back a tab therebetween; crimping in two sides of portion and inserting a piece of material beneath two sides; folding material longitudinally a number of times.

The free end of the second conductor 50 includes a second set of tabs 54 extending there from. The tabs 54 are initially set in an open configuration, so that they are spaced from one another. The cross section of the extension 46 between the connection portion 52 and the tabs 54 is U-shaped for rigidity; however, any geometry which provides sufficient rigidity can be used.

Referring to FIG. 1 and 3, in use the C-shaped clamp section 26 is slid over and encircles the battery post 16 in the open position. The nut 38 is tightened so as to draw the end walls 28 and 29 together to compress the clamp section 26 about the post 16. In the clamped or closed position, the terminal 20 achieves good mechanical and electrical connection to the battery post 16. Referring to FIG. 2, the tabs 42 are crimped into the notches 44 to secure the nut 38 against the end wall 29, and to prevent rotation of the nut 38.

The connection portion 52 of the apparatus 45 is brought into contact with the terminal base 33. Prior to connection of the first conductor 48 to the terminal, the second conductor is rotatable or movable with respect to the terminal, so that angle between the axis E2 and the central axis C may be varied as needed and is represented in phantom by the arrow a. The apparatus is free to rotate 360° so that it can be routed around engine components (not shown). Once the apparatus 45 is in the proper orientation, the first set of tabs 34 are crimped onto the connection portion.

A battery cable 56 includes an conductive core 58 of wire strands sheathed in an insulator 60. The second set of tabs 54 are crimped onto the conductive core 58 of the cable. Thus, the cable is electrically connected to the battery post 16 through the terminal. The terminal 20 and the apparatus 45 may be used with a battery 10 having a commercially available thermal insulator 62 surrounding it as shown in FIG. 2.

It will be understood that various modifications may be made to the embodiments disclosed herein. For example, the electrical terminal may be manufactured with the terminal being a single part instead of two parts. The geometry of the apparatus may vary to accommodate more than one cable or wire, such as adding additional wire connection portions or tabs for such connections. Furthermore, different fastener assemblies may be used, as well as different configurations of the body member which have various anti-rotation or stiffening features. Therefore, the above description should not be construed as limiting, but merely as exemplifications of preferred embodiments. Those skilled in the art will envision other modifications within the scope and spirit of the claims appended hereto.

We claim:

1. A terminal connection for attaching a battery cable to a battery, the battery having a first surface and a second surface, and an electrical terminal post disposed on the first surface, said terminal connection comprising:

a first conductor having first and second ends, with structure at said first end to be brought together for attachment to the electrical terminal post on the battery, said structure including spaced members which may be selectively drawn together to contact the electrical terminal post, said first conductor having a connection structure at said second end; and a second conductor having first and second ends and said first end having a second connection structure which is attached to said first connection structure on said first conductor, and having structure at said second end for attachment to the battery cable, said first and second connection structure connecting said first and second conductors such that when the battery cable is connected to said second end of said second conductor, electrical communication is made between the electrical terminal post on the battery and the battery cable; and an angle defined between said first connection structure on said first conductor and said second connection structure on said second conductor, said angle being greater than or equal to 90 degrees and less than 180 degrees, such that said terminal connection conforms to the contour between the first and second surfaces of the battery.

2. The terminal connection of claim 1, wherein said first conductor and said second conductor are moveable relative to the terminal before attaching said apparatus to the terminal.

3. A terminal connection as recited in claim 1, wherein said first and second connection structure include tabs on one of said first and second conductors, and a generally cylindrical portion on the other of said first and second conductors, said tabs deformed to contact said generally cylindrical portion, and secure said one of said first and second conductors to the other of said first and second conductors.

4. A battery and terminal connection comprising:

a first and second surface of the battery and at least one electrical terminal post disposed on said first surface;

the terminal connection having:

a first conductor having first and second ends with structure at said first end to be brought together for attachment to the electrical terminal post on the battery, said structure including spaced members drawn together to contact said electrical terminal post, said first conductor having a first connection structure at said second end; and a second conductor having first and second ends and said first end having a second connection structure which is attached to said first connection structure on said first conductor, and having structure at a second end attached to a battery cable, said first and second connection structures connecting said first and second conductors such that said battery cable is in electrical communication with said electrical terminal post on said battery; and an angle defined between said first connection structure on said first conductor and said second connection structure on said second conductor, said angle being greater than or equal to 90 degrees and less than 180 degrees such that said terminal connection conforms to the contour between said first and second surfaces of said battery.

5. A battery and terminal connection as recited in claim 4, wherein said first and second connection structure include tabs on one of said first and second conductors, and a generally cylindrical portion on the other of said first and second conductors, said tabs deformed to contact said generally cylindrical portion, and secure said one of said first and second conductors to the other of said first and second conductors.

6. The battery and terminal connection of claim 4, wherein said angle is greater than or equal to approximately 90° and less than approximately 135°.

7. The battery and terminal connection of claim 4, wherein said first conductor and said second conductor are moveable relative to the terminal before attaching said terminal connection to the terminal post.

* * * * *